US007990243B1

(12) United States Patent
Folker et al.

(10) Patent No.: US 7,990,243 B1
(45) Date of Patent: Aug. 2, 2011

(54) GULL WING SURFACE MOUNT MAGNETIC STRUCTURE

(75) Inventors: Donald Folker, Madison, AL (US); Mark Bauer, Harlingen, TX (US); J. C. Kelley, Harlingen, TX (US); Mike LeBlanc, Huntsville, AL (US); Christopher Radzinski, Huntsville, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 0 days.

(21) Appl. No.: 12/544,624

(22) Filed: Aug. 20, 2009

(51) Int. Cl.
*H01F 5/00* (2006.01)
*H01F 27/29* (2006.01)

(52) U.S. Cl. ..... 336/192; 336/200; 336/223

(58) Field of Classification Search ..... None
See application file for complete search history.

(56) References Cited

U.S. PATENT DOCUMENTS

| | | | | |
|---|---|---|---|---|
| 3,191,135 | A | 6/1965 | Hazelquist | |
| 5,165,056 | A | 11/1992 | Chien-heng | |
| 5,245,746 | A * | 9/1993 | Stokes | 29/605 |
| 5,804,895 | A | 9/1998 | Tsuzaki et al. | |
| 5,928,373 | A * | 7/1999 | Yoo | 714/719 |
| 6,441,714 | B2 * | 8/2002 | Maeda | 336/198 |
| 6,755,692 | B2 | 6/2004 | Hsu | |
| 7,154,365 | B2 | 12/2006 | Oarj | |
| 7,564,335 | B1 * | 7/2009 | Yang | 336/192 |
| 7,724,115 | B2 * | 5/2010 | Chen et al. | 336/198 |
| 7,772,957 | B2 * | 8/2010 | Chen et al. | 336/208 |
| 2009/0309686 | A1 * | 12/2009 | Espino | 336/182 |

FOREIGN PATENT DOCUMENTS

| | | | |
|---|---|---|---|
| JP | 2005353365 | A * | 12/2005 |
| JP | 2007080851 | | 3/2007 |

* cited by examiner

*Primary Examiner* — Anh T Mai
(74) *Attorney, Agent, or Firm* — Waddey & Patterson; Mark J. Patterson; Gary L. Montle

(57) ABSTRACT

A magnetic device is provided for placement on the top surface of a printed circuit board with surface mount connection on the bottom surface. The circuit board includes first and second sets of slots bisecting each other. The device includes a bobbin with a plurality of support members each having a face shaped to engage the top surface of the printed circuit board and a plurality of pins attached to the support members. The pins have a first portion shaped to pass through the first set of slots, and a second portion shaped to pass through the second set of slots. The second portion of the pins is shaped to engage the bottom surface of the circuit board, locking the magnetic device in place against the top surface of the circuit board and providing a soldering area for surface mounting on the bottom surface.

20 Claims, 3 Drawing Sheets

GULL WING SURFACE MOUNT MAGNETIC STRUCTURE

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

Not applicable.

BACKGROUND OF THE INVENTION

The present invention relates generally to magnetic device structures. More particularly, the present invention relates to an improved system and method for mounting magnetic devices on printed circuit boards. Even more particularly, the present invention relates to a gull wing pin configuration permitting placement of magnetic devices on the top side of printed circuit boards while surface mount solder joints are made to the underside of printed circuit boards configured to receive them.

Designers of magnetic devices such as transformers or inductors were at one time primarily concerned with core material and size. In recent years however, mounting and packaging have become progressively more important with regards to the ability of the magnetic devices to be efficiently mounted on a printed circuit board. This ability directly relates to the total cost of the component, as space on such boards is generally limited. As the packaging or housing sizes for electronic apparatuses also become smaller and flatter, the height of the magnetic components on printed circuit boards also becomes critical. Rework, inspection and production costs are also relevant factors that must be considered in magnetic device design.

On single sided printed circuit boards, the larger components are placed on the top side of the board (generally the side with no pads or traces). The surface mount parts which are normally small are placed on the bottom side of the printed circuit board (generally the side with pads and traces). Placing a larger surface mount magnetic on the bottom side of the printed circuit board would greatly increase the height of the assembly, which is undesirable.

It is desirable, therefore, to provide a magnetic device assembly that would allow for placement of the large portion of a magnetic device on the top side of a printed circuit board while the surface mount solder joint is made to the bottom of the printed circuit board.

BRIEF SUMMARY OF THE INVENTION

The present invention provides a system and method for locating a magnetic device on the top surface of a printed circuit board and surface mounting the magnetic device on the bottom surface of the printed circuit board.

The magnetic device is wound on a bobbin which incorporates a plurality of terminating pins which are bent at a right angle, also known as a gull wing configuration. The magnetic device is inserted into the printed circuit board from the top side of the board through a specially designed slot and is connected to the bottom side of the printed circuit board using a surface mount solder joint connection. The slot in the printed circuit board is designed for easy insertion and to hold the magnetic in place through the soldering process. An elongate lateral portion of the pin provides for a strong surface mount solder joint connection on the bottom side of the printed circuit board.

The gull wing termination allows for placing the surface mount connections on the bottom side of the printed circuit board, further allowing for a new method of surface mounting large magnetic components. The gull wing termination locks the magnetic components in place for efficient and effective soldering, further eliminating legouts and controlling the height of the component above the top surface of the printed circuit board.

In one embodiment of the present invention, a magnetic device is provided for mounting on a printed circuit board having a top surface, a bottom surface, and a plurality of generally L-shaped apertures extending through the printed circuit board from the top surface to the bottom surface, the magnetic device comprising: a bobbin around which is wound a coil, the bobbin comprising a plurality of support members each having a face shaped to engage the top surface of the printed circuit board; and a plurality of pins, at least one pin attached to each of the plurality of support members, the pins having a transverse portion extending perpendicular to the face of the associated support member, and the pins further having a lateral portion extending parallel to the face of the associated support member, the lateral portion shaped to engage the bottom surface of the printed circuit board.

In another embodiment of the present invention, a magnetic device surface mounting assembly is provided, comprising: a printed circuit board having a first surface, a second surface, a first set of channels having a first configuration extending from the first surface to the second surface, and a second set of channels having a second configuration bisecting the first set of channels and extending from the first surface to the second surface, the first and second surfaces defining a width; and a magnetic device having at least one support portion with a face shaped to engage the first surface of the circuit board and a plurality of pins extending from the at least one face, each pin having a first portion attached to the associated face and extending transversely with respect to said face, and each pin having a second portion positioned distal from said face and extending laterally with respect to said face.

A method for locating a magnetic device on the top surface of a printed circuit board and surface mounting the magnetic device on the bottom surface of the printed circuit board in accordance with the present invention further comprises: providing a printed circuit board having a first surface, a second surface, a first set of slots, and a second set of slots; providing a magnetic device having one or more faces, a plurality of pins having a first portion extending from the faces; placing the magnetic device into a first position engaging the first surface of the circuit board by inserting the plurality of pins through the first set of slots; placing the magnetic device into a second position engaging the circuit board by sliding the plurality of pins through the second set of slots, at least a second portion of said pins secured from transverse movement relative to the second surface of the circuit board.

DETAILED DESCRIPTION OF THE INVENTION

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may. The term "coupled" means at least either a direct electrical connection between the connected items or an indirect connection through one or more passive or active intermediary devices. The term "circuit" means at least either a single component or a multiplicity of components, either active and/or passive, that are coupled together to provide a desired function. "Printed circuit board" and "printed wiring board" are used within this description interchangeably and have the meanings commonly understood within the art.

Referring generally to FIGS. 1-5, a magnetic device able to be located on the top surface of a printed circuit board and surface mounted to the bottom surface of the circuit board is herein described.

Figure 1:
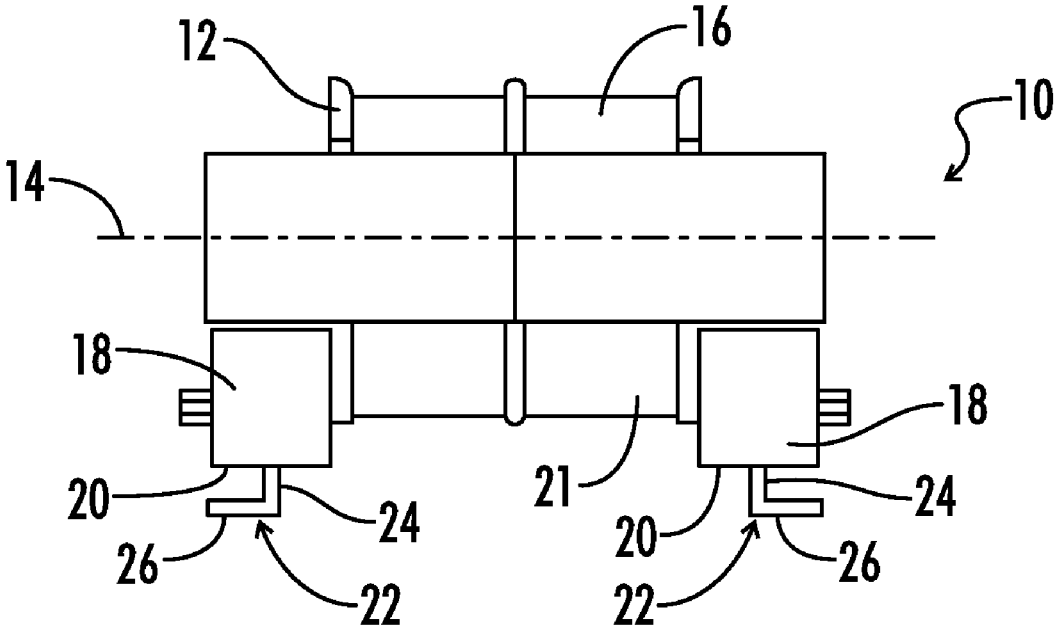
FIG. 1 is a side view of one embodiment of the magnetic device of the present invention with gull wing termination pins.

Referring first to FIG. 1, in an embodiment of the present invention the magnetic device 10 may comprise a transformer or an inductor having a bobbin 12 and a winding axis 14 about which may be wound a coil 16. The winding axis 14 may be perpendicular or parallel to the surface of a printed circuit board (PCB), depending on the application and without substantially affecting the inventive features of the present invention.

The bobbin 12 of the embodiment shown further has a plurality of support portions 18 or support members 18. Each support member 18 has a face 20 shaped to engage the top surface of a PCB such that the weight of the magnetic device 10 may be supported by the support members 18 when so engaged. The support members 18 may further extend a certain distance from the remainder of the bobbin 12 so as to stand off the bottom surface 21 of the bobbin 12 from the top surface of the PCB when the magnetic device 10 is so engaged.

The magnetic device 10 of the embodiment shown further includes a plurality of pins 22, each pin 22 associated with a support member 18. In certain embodiments each pin 22 may be attached to a separate support member 18, while in other embodiments it is anticipated that multiple pins 22 may be attached to a single support member 18. Each pin 22 has a first portion 24 attached to the support member 18 and a second portion 26 located distal from the support member 18.

In the embodiment of FIG. 1, the first portion 24 of each pin 22 is attached to the face 20 of the associated support member 18 and extends outward and substantially transverse and perpendicular with respect to the face 20. The first portion 24 or transverse portion 24 of this embodiment further has a distal end from which the second portion 26 extends laterally and parallel with respect to the face 20. The second portion 26 or lateral portion 26 of this embodiment further is shaped to engage the surface of a circuit board. The pins 22 will generally be attached to the face 20 by press fitting the pin 22 into the face 20, but may conceivably be attached by other desired methods as known in the art.

In alternative embodiments, the lateral portion 26 of the pin 22 may not extend directly from the distal end of the transverse portion 24, but the pin 22 may instead further be one or more additional portions of varying configuration, such as for example a curved intermediate portion between the transverse 24 and lateral 26 portions of the pin 22. It may be further anticipated that the pin 22 alternatively may have a single curved portion along its length.

Figure 2:
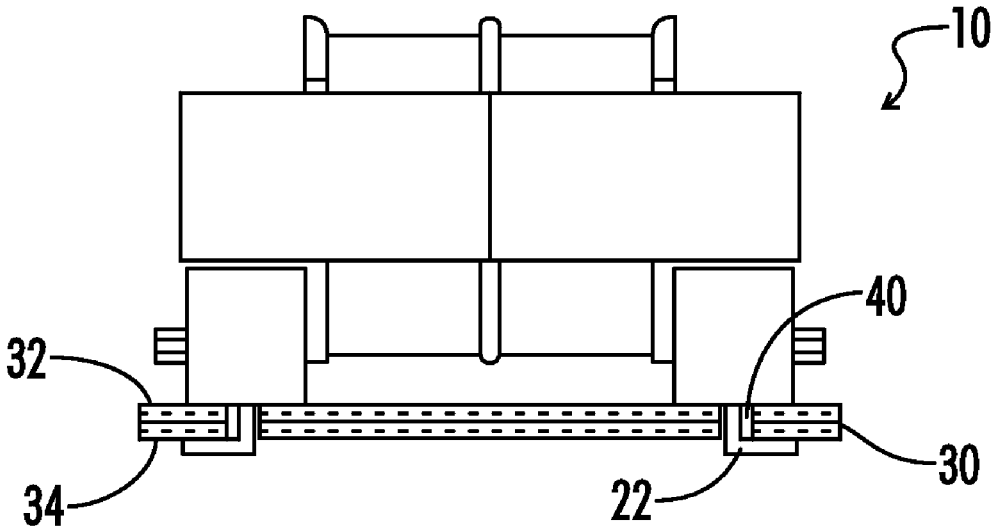
FIG. 2 shows the magnetic device of the embodiment of FIG. 1 in combination with a printed circuit board arranged to receive the gull wing termination pins.

Referring now to FIG. 2, in an embodiment a magnetic device surface mount assembly 1 of the present invention is shown with a magnetic device 10 positioned with respect to a PCB 30 shaped to receive and secure the magnetic device 10. The PCB 30 has a first surface 32 and a second surface 34. For orientation purposes only, the first surface 32 may be referred to herein as the top surface 32 and the second surface 34 may be referred to as the bottom surface 34, but these distinctions are not intended as limiting upon the ultimate orientation of the PCB 30 itself within an electronic apparatus. The first and second surfaces 32, 34 together define a width of the PCB 30.

Referring generally now to FIGS. 1-3F, the PCB 30 has a plurality of apertures 36 at least corresponding in number to the plurality of pins 22 on the magnetic device 10, each aperture 36 extending through the PCB 30 from the first surface 32 to the second surface 34. Each aperture 36 as shown in FIG. 3A has a first channel 38 or slot 38 and a second channel 40 or slot 40 bisecting the first channel 38. The channels 38, 40 in combination within the shown embodiment define a generally L-shaped aperture 36. However, the aperture 36 may take various other shapes within the understanding of the present invention.

Figure 3A:
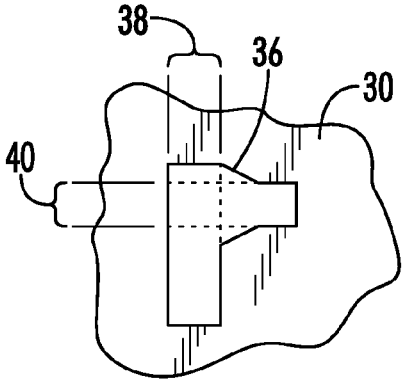
FIG. 3A shows a bottom view of an aperture of the printed circuit board from the embodiment of FIG. 2.
Figure 3B:
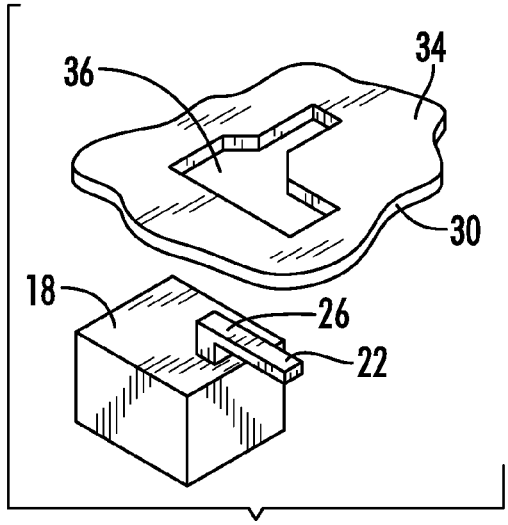
FIG. 3B shows an isometric view of the aperture of FIG. 3A with a gull wing termination pin.
Figure 3C:
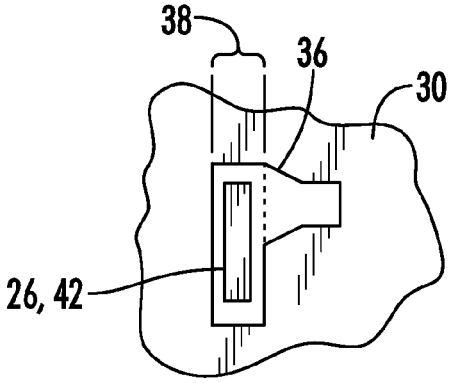
FIG. 3C shows the bottom view of the aperture of FIG. 3A with the lateral portion of the gull wing termination pin located in a first position.
Figure 3D:
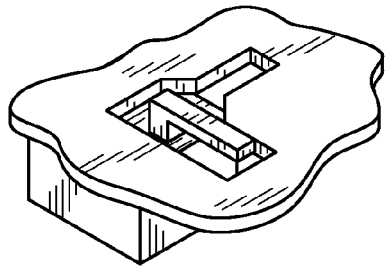
FIG. 3D shows an isometric view of the embodiment shown in FIG. 3C.

Referring now to FIGS. 3C-3D, the first channel 38 of each aperture 36 is shaped to receive the lateral portion 26 of each pin 22. The magnetic device 10 with the pins 22 so received by the first channels 38 of the PCB 30 may define a first position 42 of the magnetic device 10 with respect to the PCB 30.

Figure 3E:
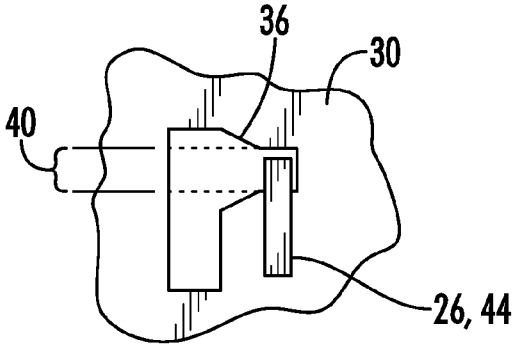
FIG. 3E shows the bottom view of the aperture of FIG. 3A with the lateral portion of the gull wing termination pin located in a second position.
Figure 3F:
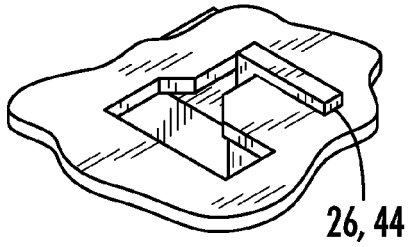
FIG. 3F shows an isometric view of the embodiment shown in FIG. 3E.

Referring now to FIGS. 2 and 3E-3F, the second channel 40 of each aperture 36 is shaped to receive the transverse portion 24 of each pin 22 when the magnetic device 10 is in the first position 42 and generally engaging the top surface 32 of the PCB 30. The magnetic device 10 is thereby permitted to slide laterally from the first position 42 along the second channel 40 to define a second position 44 of the magnetic device 10 relative to the PCB 30. In certain embodiments as shown, the aperture 36 may further include connecting portions between the channels 38, 40 such that the lateral sliding of the magnetic device 10 between the first and second positions 42, 44 is facilitated. The connecting portions may be angled, curved, or other configurations as may be typically understood. It may be further understood by reference to the drawings that in the second position 44 the magnetic device 10 is substantially prevented from transverse or upward movement relative to the PCB 30, as the lateral portion 26 of each pin 22 is in engagement with the bottom surface 34 of the PCB 30.

In the embodiment as shown in FIGS. 3A-3F, the aperture 36 is shaped to receive a gull wing termination pin 22 having a lateral portion 26 and a transverse portion 24 substantially perpendicular to each other. In alternative embodiments the first and second channels 38, 40 of the aperture 36 may be shaped to receive pins 22 having a different configuration, such as a single curved portion or a diagonal shaped first portion attached to a lateral portion, or various other configurations as may be understood by one having knowledge in the art.

Figure 4A:
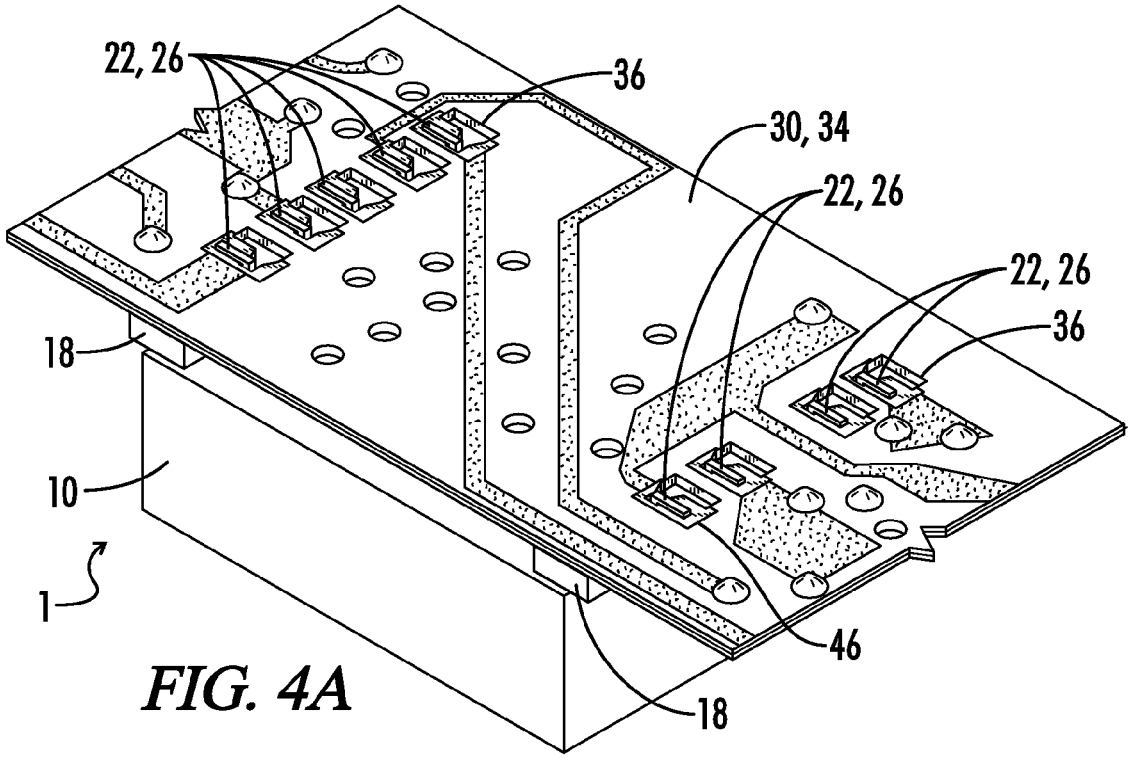
FIG. 4A shows an isometric bottom view of an embodiment of a magnetic device gull wing surface mount assembly of the present invention.
Figure 4B:
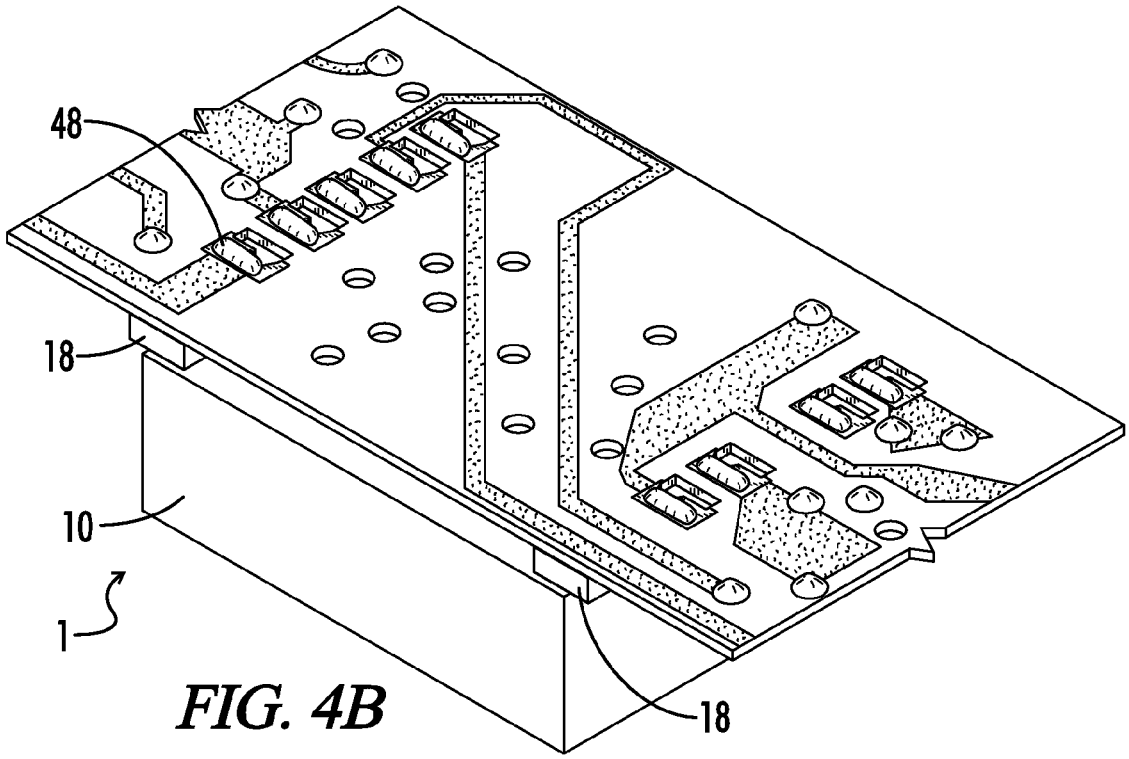
FIG. 4B shows the surface mount assembly of FIG. 4A with the gull wing termination pins surface mount soldered into place on the printed circuit board.

Referring now to FIGS. 4A-4B, an embodiment of the magnetic device surface mount assembly 1 is shown with the plurality of pins 22 in the second position 44 against the bottom surface 34 of the printed circuit board 30. The lateral portions 26 of the pins 22 are fully extended through the apertures 36 and locked into place against the bottom surface 34. This effectively locks the magnetic device 10 into place on the circuit board 30 and also prevents bad solder joints that may result where the pins 22 do not properly extend through the through holes 36, such bad connections also known as legouts.

The bottom surface 34 of the PCB 30 may have a plurality of solder joint areas 46 or solder pads 46 generally corresponding with the plurality of pins 22 when the magnetic device 10 is in the second position 44. The lateral portions 26 of the pins 22 may then be manually soldered or otherwise affixed to the bottom surface 34 so as to form surface mount solder joints 48 in a manner known in the art.

Referring generally again to FIGS. 1-4B, a method of locating a magnetic device on the top surface of a printed circuit board and surface mounting the device to the bottom surface of the circuit board is herein described, including the steps of providing a printed circuit board having a first surface, a second surface, a first set of slots, and a second set of slots; providing a magnetic device having one or more faces, a plurality of pins having a first portion extending from the faces; placing the magnetic device into a first position engaging the first surface of the circuit board by inserting the plurality of pins through the first set of slots; and placing the magnetic device into a second position engaging the circuit board by sliding the plurality of pins through the second set of slots, at least a second portion of said pins secured from transverse movement relative to the second surface of the circuit board.

In certain embodiments the method may further include soldering at least one of the pins to the second surface of the printed circuit board. In alternative embodiments it may be anticipated that the at least one pins be affixed to the second surface of the printed circuit board in other manners as known in the art.

The previous detailed description has been provided for the purposes of illustration and description. Thus, although there have been described particular embodiments of the present invention of a new and useful "Gull Wing Surface Mount Magnetic Structure," it is not intended that such references be construed as limitations upon the scope of this invention except as set forth in the following claims.

What is claimed is:

1. A magnetic device for mounting on a printed circuit board having a top surface, a bottom surface, and a plurality of generally L-shaped apertures extending through the printed circuit board from the top surface to the bottom surface, the magnetic device comprising:

first and second parallel and opposing sides;

a bobbin around which is wound a coil, the bobbin comprising one or more support members positioned along the first side of the device and one or more support members positioned along the second side of the device, each of said support members having a face shaped to engage the top surface of the printed circuit board; and a plurality of pins, at least one pin attached to each of the plurality of support members, the pins having a transverse portion extending perpendicular to the face of the associated support member, the pins further having a lateral portion extending parallel to the face of the associated support member, the lateral portion shaped to engage the bottom surface of the printed circuit board the lateral portions of each pin on the first or second side of the device extending away from the pins on the opposing side.

2. The magnetic device of claim 1, wherein the pins are attached to the faces of the plurality of support members and extend outward from the support members and perpendicular to the faces.

3. The magnetic device of claim 1, the lateral portion of each pin configured to pass through a first portion of an associated L-shaped aperture.

4. The magnetic device of claim 3, the transverse portion of each pin configured to pass through a second portion of said L-shaped aperture.

5. The magnetic device of claim 4, the lateral portion of each pin and the face of the associated support member defining a distance, the distance minutely greater than a width of the printed circuit board defined by the top surface and the bottom surface of the printed circuit board.

6. The magnetic device of claim 5, wherein the lateral portion of each pin generally engages the bottom surface of the printed circuit board when the transverse portion of said pin passes through the second portion of said L-shaped aperture.

7. A magnetic device surface mounting assembly, further comprising:

a printed circuit board having a first surface, a second surface, and first and second arrays of apertures, each of said apertures comprising a first channel having a first configuration extending from the first surface to the second surface, and a second channel having a second configuration bisecting the first channel and extending from the first surface to the second surface, the configurations of the first and second channels for each aperture in said first array being inverted with respect to the configurations of the first and second channels for each aperture in said second array;

the first and second surfaces defining a width; and a magnetic device having first and second opposing sides, each side comprising at least one support portion with a face shaped to engage the first surface of the circuit board and one or more pins extending from each face, each pin having a first portion attached to the associated face and extending transversely with respect to said face, each pin having a second portion positioned distal from said face and extending laterally with respect to said face.

8. The assembly of claim 7, the first channels for each of said apertures arranged to receive each of said second portions of said plurality of pins.

9. The assembly of claim 8, the plurality of pins so received by the first channels of the printed circuit board defining a first position for the magnetic device.

10. The assembly of claim 9, the second portions of said plurality of pins and the support portions of said magnetic device defining a distance, said distance minutely larger than the width of said circuit board.

11. The assembly of claim 10, the second channels for each of said apertures arranged to receive each of said first portions of said plurality of pins.

12. The assembly of claim 11, the plurality of pins so received by the second channels of the printed circuit board defining a second position for the magnetic device.

13. The assembly of claim 12, wherein the magnetic device in the second position is prevented from transverse movement with respect to the first and second surfaces of the circuit board.

14. The assembly of claim 13, the second surface of the circuit board further comprising a plurality of solder pads corresponding with the plurality of pins when the magnetic device is in the second position, wherein the solder pads facilitate surface mount soldering of the pins so as to comprise a plurality of solder joints affixing the magnetic device to the circuit board.

15. The assembly of claim 10, the second channels arranged to receive each of said first portions of said plurality of pins and thereby define a plurality of second positions for the magnetic device.

16. The assembly of claim 15, wherein the magnetic device in any of said second positions is prevented from transverse movement with respect to the first and second surfaces of the circuit board.

17. The assembly of claim 7, the bobbin further comprising a winding axis around which is wound a coil, the winding axis being perpendicular to the first surface of the circuit board.

18. The assembly of claim 7, the bobbin further comprising a winding axis around which is wound a coil, the winding axis being parallel to the first surface of the circuit board.

19. A method of surface mounting a magnetic device, the method comprising:

providing a printed circuit board having a first surface, a second surface, and first and second rows of apertures, each of said apertures comprising a first slot and a second slot, a configuration of the first and second slots for each aperture in said first row being inverted with respect to the configurations of the first and second slots for each aperture in said second row;

providing a magnetic device having first and second opposing sides, one or more faces positioned along each side, and one or more pins having a first portion extending from each of the faces;

placing the magnetic device into a first position engaging the first surface of the circuit board by inserting the plurality of pins through corresponding first slots;

placing the magnetic device into a second position engaging the circuit board by sliding the plurality of pins through the corresponding second slots, at least a second portion of said pins secured from transverse movement relative to the second surface of the circuit board.

20. The method of claim 19, further comprising soldering at least one of said pins to the second surface of the circuit board.

* * * * *